US007509743B2

(12) United States Patent
Oh

(10) Patent No.: US 7,509,743 B2
(45) Date of Patent: Mar. 31, 2009

(54) ELECTRIC HAIR CLIPPER

(76) Inventor: Tae-Jun Oh, Bupyeong6-ri, Jingeop-eup, Namyangju-shi, 472-864, Gyeonggi-do (KR)

( * ) Notice: Subject to any disclaimer, the term of this patent is extended or adjusted under 35 U.S.C. 154(b) by 65 days.

(21) Appl. No.: 11/471,261

(22) Filed: Jun. 20, 2006

(65) Prior Publication Data

US 2006/0283022 A1 Dec. 21, 2006

(30) Foreign Application Priority Data

Jun. 21, 2005 (KR) ..... 20-2005-0017858 U

(51) Int. Cl.
*B26B 19/20* (2006.01)

(52) U.S. Cl. ..... 30/201; 30/200

(58) Field of Classification Search ..... 30/201, 30/202, 194–196, 215–220, 233.5, 241, 43.91, 30/43.92, 42, 44, 46, 200
See application file for complete search history.

(56) References Cited

U.S. PATENT DOCUMENTS 4,753,234 A * 6/1988 Martinez ..... 606/171
4,776,095 A * 10/1988 Tsujimoto et al. ..... 30/201
4,825,546 A * 5/1989 Araki et al. ..... 30/201
5,898,999 A * 5/1999 Chaouachi et al. ..... 30/201
5,979,060 A * 11/1999 Holzbauer et al. ..... 30/201
7,249,416 B2 * 7/2007 Yamaguchi et al. ..... 30/43.91

* cited by examiner

*Primary Examiner*—Boyer D Ashley
*Assistant Examiner*—Omar Flores-Sánchez
(74) *Attorney, Agent, or Firm*—Cantor Colburn LLP

(57) ABSTRACT

Disclosed is an electric hair clipper. A movable blade is reciprocated by a pin cam to perform hair-cutting. A comb cap is attached to an outer surface of the hair clipper body. A drive bolt is mounted in a lower region of the hair clipper body. A tension spring is mounted around the outer peripheral surface of the drive bolt. A nut member is provided to allow the drive bolt to be penetrated there through and formed at an inner peripheral surface thereof with screw grooves. A shock-absorbing spring is provided, one end of which is attached to a plate fixed to an inner bottom surface of the body and the other end thereof is attached to a shock-absorbing bar. Up and Down switches are formed at opposite lateral surfaces of the body at lower ends of the lateral surfaces to forwardly and rearwardly reciprocate the comb cap.

1 Claim, 6 Drawing Sheets

ELECTRIC HAIR CLIPPER

BACKGROUND OF THE INVENTION

1. Field of the Invention

The present invention relates to an electric hair clipper, and more particularly, to an electric hair clipper in which a comb cap is located below a movable blade used to perform a hair cutting operation, thereby achieving convenient use and operation and improved hair cutting efficiency.

2. Description of the Related Art

Scissors are mainly used as home haircut tools.

In order to cut hair with scissors, a user has to operate the scissors with his/her one hand while gripping hair with fingers of the other hand, and therefore, it is difficult for unskilled people to cut hair with scissors.

In particular, when blade edges of the scissors are brought into contact with each other while being inclined with respect to hair caught therebetween, the hair may slide to inappropriate positions along the blade edges. This makes it difficult to provide an even haircut.

Accordingly, it can be understood that performing an even haircut with scissors is a highly delicate job and is impractical at home.

For this reason, power driven type hair clippers have been used at home long time ago. The hair clippers are easy to operate and make it easy for unskilled people to perform an even haircut. U.S. Pat. No. 4,825,546 discloses a hair clipper including a cutter head, which comprises a set of stationary blade and movable blade each having teeth in its forward edge. The movable blade is driven to be reciprocated on the stationary blade while the teeth of both the moveable and stationary blades are engaged with each other for cutting hair.

The disclosed hair clipper further includes a comb member, which protrudes beyond the cutting blade edge of the cutter head. In operation, the comb member is shifted to the front of the cutting blade edge that is held to come into contact with or close to the skin of a user.

Therefore, the disclosed hair clipper requires very careful operation to prevent damage to the skin of a user.

This is especially important when cutting children's hair. As can be understood from the above description, the disclosed hair clipper is still unsatisfactory to perform an easy and safe haircut. This problem of the prior art can be eliminated by the present invention, which enables safe and easy operation by unskilled people and in particular, is suitable for use at home.

SUMMARY OF THE INVENTION

Therefore, the present invention has been made in view of the above problems, and it is an object of the present invention to provide an electric hair clipper in which a comb cap is located below a movable blade used to perform a hair cutting operation, thereby achieving convenient use and operation and improved hair cutting efficiency.

In accordance with the present invention, the above and other objects can be accomplished by the provision of an electric hair clipper comprising a pin cam adapted to be operated by a drive motor received in a clipper body, and a movable blade adapted to be reciprocated by the pin cam to perform a hair cutting operation, further comprising: a drive bolt mounted in a lower region of the body, and having one end provided with a joint member, which is connected to a shaft of an operating motor, and the other end penetrated through an insertion hole of a Z-shaped plate, the drive bolt being formed with screw threads at approximately a half of an outer peripheral surface, a tension spring being mounted around the remainder of the outer peripheral surface of the drive bolt; a nut member configured to allow the drive bolt to be penetrated therethrough, the nut member being formed at an inner peripheral surface thereof with screw grooves; a connection link having an upper portion through which the nut member fixedly penetrates, and a lower end fastened to a comb cap by use of a bolt, the comb cap being attached to an outer surface of the body; a shock-absorbing spring having one end attached to a plate fixed at a front location of an inner bottom surface of the body, and the other end attached to a shock-absorbing bar; and Up and Down switches formed at opposite lateral surfaces of the body at lower ends of the lateral surfaces, and used to forwardly and rearwardly reciprocate the comb cap.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be explained in detail with reference to the accompanying drawings.

Figure 1:
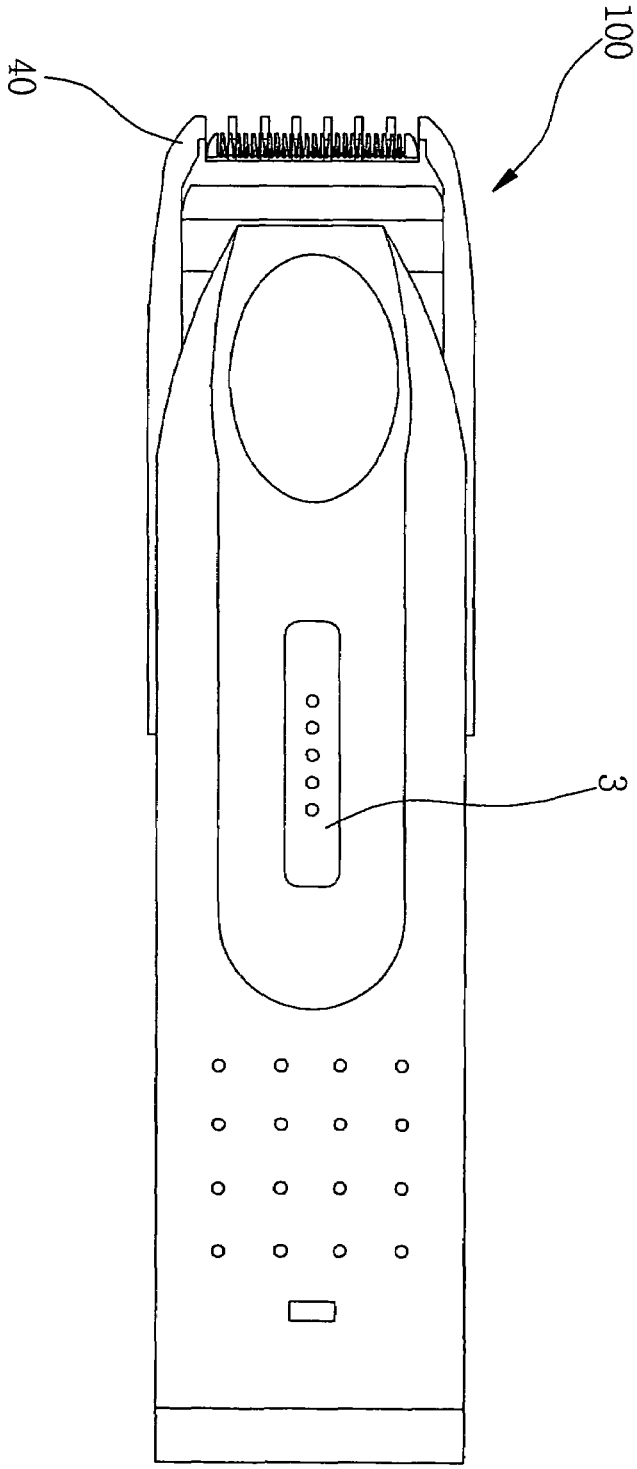
FIG. 1 is a plan view illustrating the outer configuration of an electric hair clipper according to the present invention.
Figure 2:
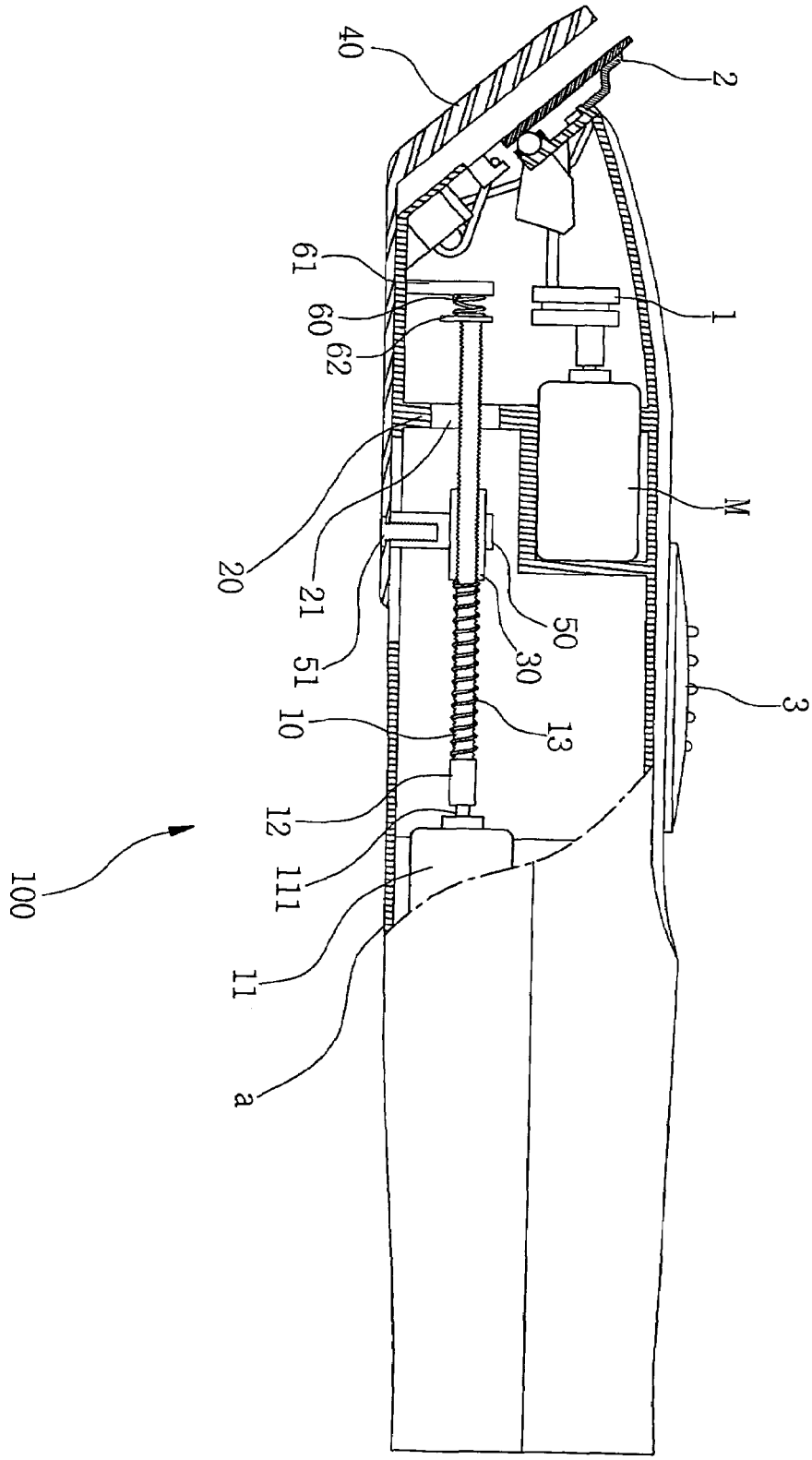
FIG. 2 is a side sectional view illustrating the inner configuration of the electric hair clipper according to the present invention.
Figure 3:
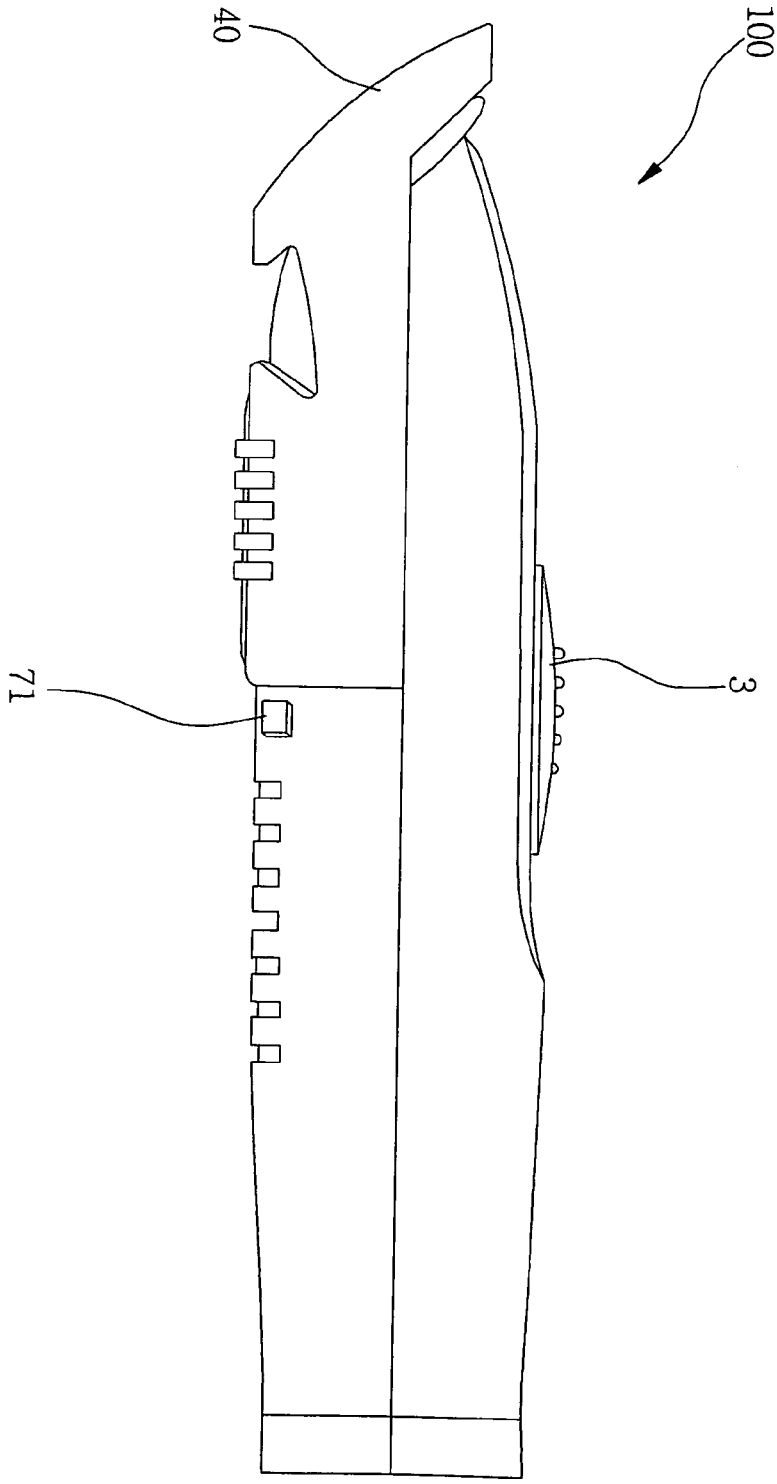
FIG. 3 is a side view of the electric hair clipper according to the present invention.
Figure 4:
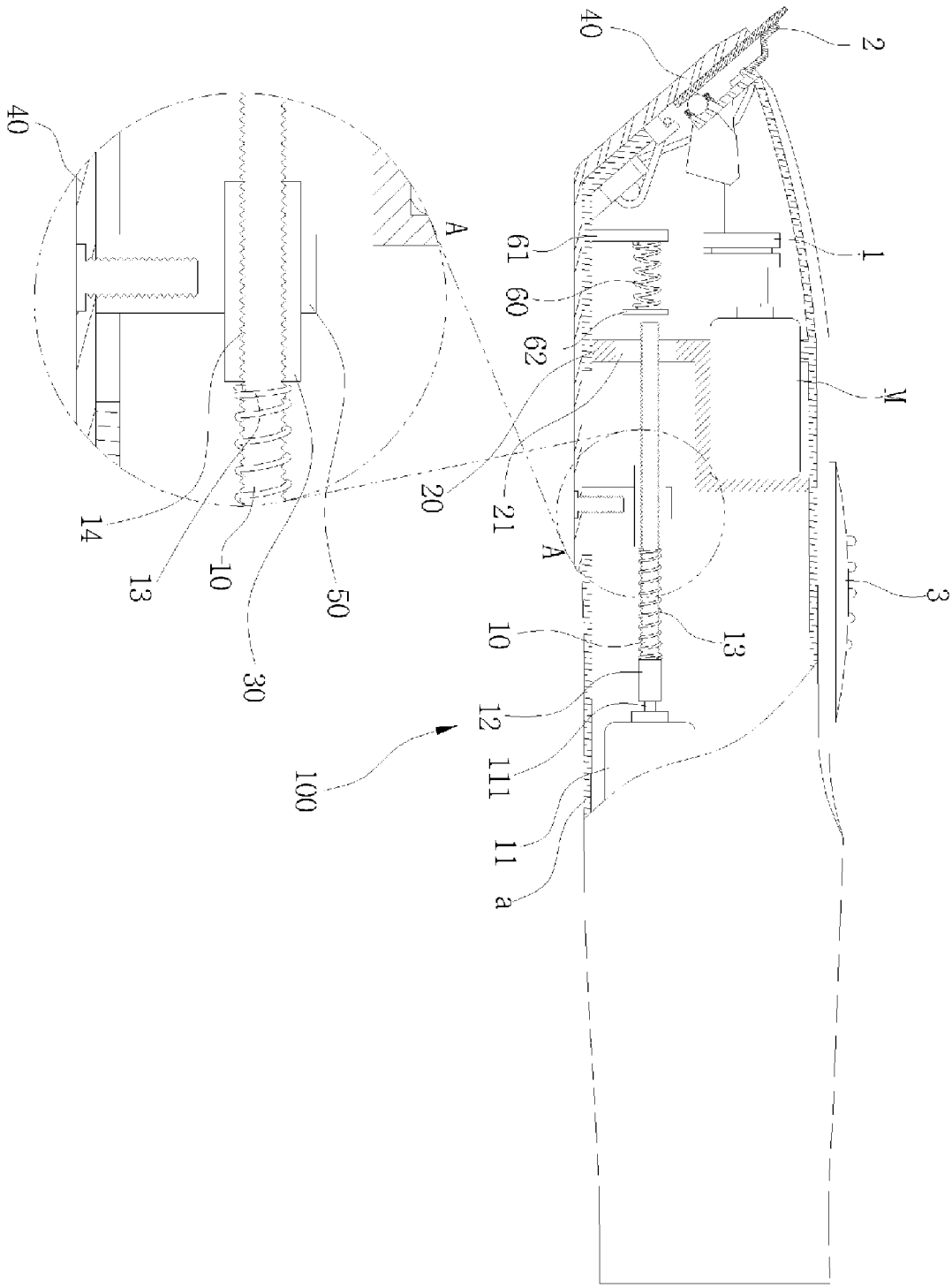
FIG. 4 is a partial sectional view illustrating a comb cap mounted to the electric hair clipper according to the present invention.
Figure 5:
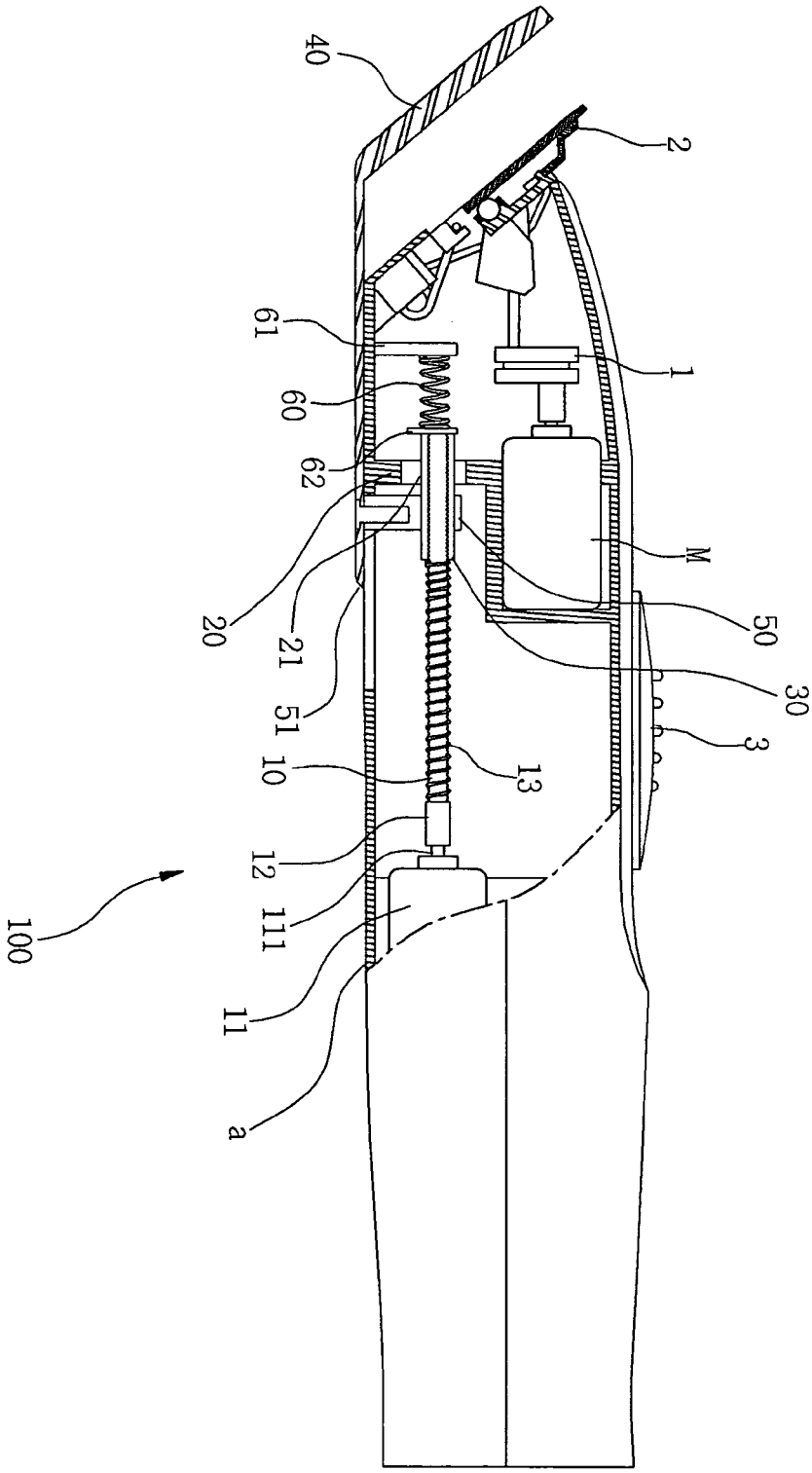
FIG. 5 is a partial sectional view illustrating a comb cap protruded from the electric hair clipper according to the present invention.
Figure 6:
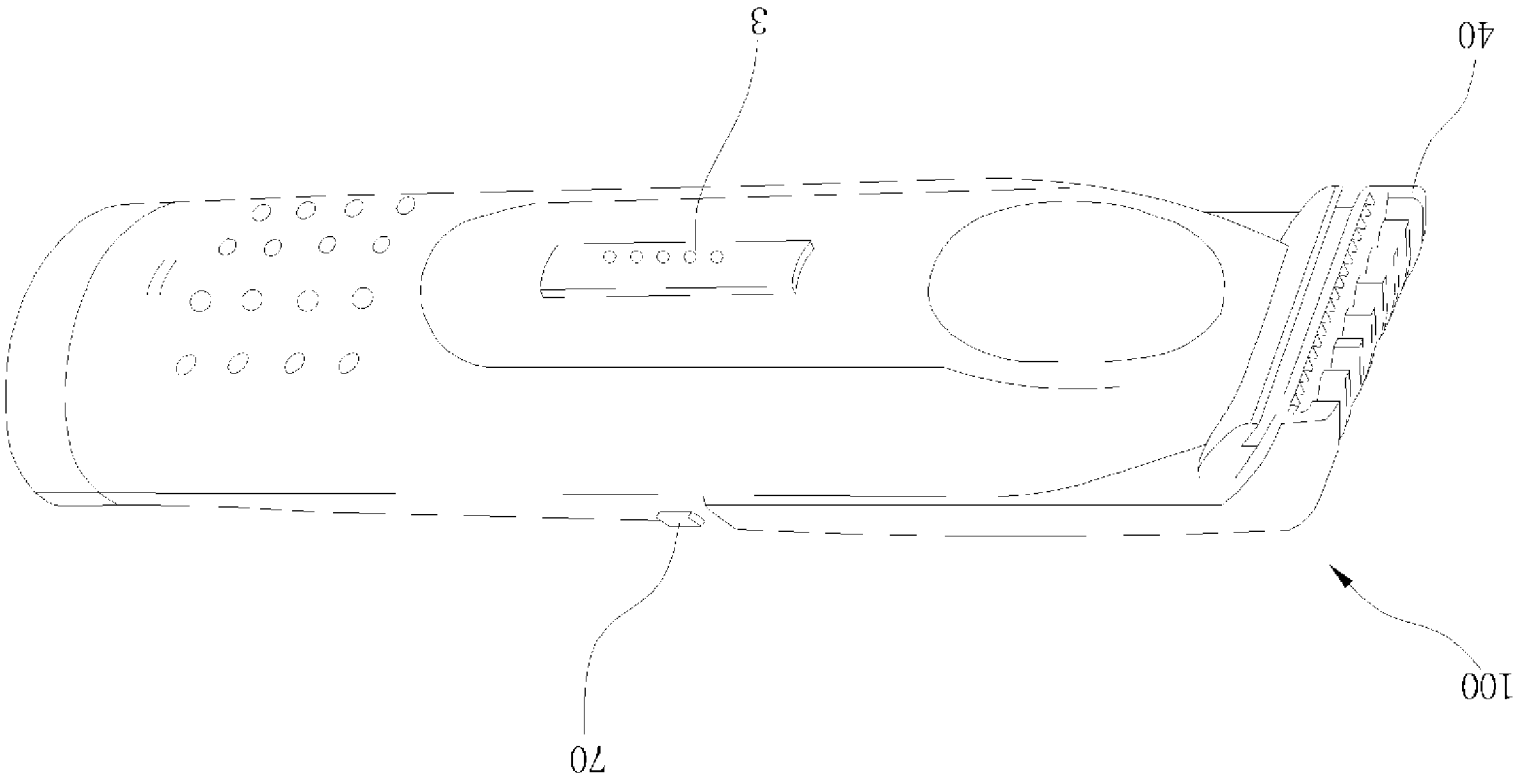
FIG. 6 is a perspective view of the electric hair clipper according to the present invention.

Explaining the accompanying drawings, FIG. 1 is a plan view illustrating the outer configuration of an electric hair clipper according to the present invention, FIG. 2 is a side sectional view illustrating the inner configuration of the electric hair clipper, FIG. 3 is a side view of the electric hair clipper, FIG. 4 is a partial sectional view illustrating a comb cap mounted to the electric hair clipper, FIG. 5 is a partial sectional view illustrating a comb cap protruded from the electric hair clipper, and FIG. 6 is a perspective view of the electric hair clipper.

In the present invention, as stated above, it should be noted that the electric hair clipper 100 comprises a comb cap 40 mounted below a movable blade 2 used to cut hair, thereby achieving convenient use and operation and improved hair cutting efficiency.

The electric hair clipper 100 of the present invention basically includes a drive bolt 10, a nut member 30, a connection link 50, and a shock-absorbing spring 60.

Considering the configuration of the electric hair clipper 100 in detail, the movable blade 2 is reciprocated by a pin cam 1 that is operated by a drive motor M received in a clipper body (a), to perform a hair cutting operation.

The drive bolt 10 is mounted in a lower region of the body (a), and has one end provided with a joint member 12, which is connected to a shaft 111 of an operating motor 11, and the other end penetrated through an insertion hole 21 of a Z-shaped plate 20. The drive bolt 10 is formed with screw threads 14 at approximately a half of an outer peripheral surface thereof, and a tension spring 13 is mounted around the remainder of the outer peripheral surface of the drive bolt 10.

The nut member 30 is configured such that the drive bolt 10 penetrates therethrough, and is formed at an inner peripheral surface thereof with screw grooves 31.

The connection link 50 has an upper portion through which the nut member 30 fixedly penetrates, and a lower end fastened to the comb cap 40 by use of a bolt 51. Here, the comb cap 40 is attached to an outer surface of the clipper body (a).

The shock-absorbing spring 60 has one end attached to a fixed plate 61 that is mounted at a front location of an inner bottom surface of the body (a), and the other end attached to a shock-absorbing bar 62.

In addition to the above described configuration, the electric hair clipper of the present invention further comprises an Up switch 70 (FIG. 6) and a Down switch 71 (FIG. 3) formed, respectively, at opposite lateral surfaces of the body (a) at lower ends of the lateral surfaces. The Up and Down switches are used to operate the comb cap 40. Specifically, the Up switch 7O is pushed to protrude the comb cap 40 forward from the body (a) when a hair cutting operation is performed, whereas the Down switch 71 is pushed to retract the comb cap 40 and keep the comb cap 40 in a storage position when the hair cutting operation is finished. The Up and Down switches enable free manual operation of the comb cap 40, resulting in convenient use and operation and improved hair cutting efficiency of the electric hair clipper.

As apparent from the above description, in the electric hair clipper having the comb cap according to the present invention, Up and Down switches are provided at opposite lateral surfaces of the clipper at lower ends of the lateral surfaces. Thereby, the Up switch is pushed to protrude the comb cap, thus allowing the user's hair to be stably caught by the comb cap during a hair cutting operation. After completing the hair cutting operation, the Down switch is pushed to retract the comb cap and to keep the comb cap in a storage position. With this configuration, free manual operation of the comb cap is possible, resulting in convenient use and operation and improved hair cutting efficiency of the electric hair clipper.

Although the electric hair clipper according to the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An electric hair clipper comprising a pin cam adapted to be operated by a drive motor received in a clipper body, and a movable blade adapted to be reciprocated by the pin cam to perform a hair cutting operation, further comprising:

a drive bolt mounted in a lower region of the body, and having one end provided with a joint member, which is connected to a shaft of an operating motor, and the other end penetrated through an insertion hole of a Z-shaped plate, the drive bolt being formed with screw threads at approximately a half of an outer peripheral surface, a tension spring being mounted around the remainder of the outer peripheral surface of the drive bolt;

a nut member configured to allow the drive bolt to be penetrated therethrough, the nut member being formed at an inner peripheral surface thereof with screw grooves;

a connection link having an upper portion through which the nut member fixedly penetrates, and a lower end fastened to a comb cap by use of a bolt, the comb cap being attached to an outer surface of the body;

a shock-absorbing spring having one end attached to a plate fixed at a front location of an inner bottom surface of the body, and the other end attached to a shock-absorbing bar; and Up and Down switches formed at opposite lateral surfaces of the body at lower ends of the lateral surfaces, and used to forwardly and rearwardly reciprocate the comb cap.

* * * * *